US009599384B2

(12) United States Patent
Weyna et al.

(10) Patent No.: US 9,599,384 B2
(45) Date of Patent: Mar. 21, 2017

(54) COMPRESSOR DISCHARGE CONTROL ON A TRANSPORT REFRIGERATION SYSTEM

(75) Inventors: Paul V. Weyna, Manlius, NY (US); Eliot W. Dudley, Cato, NY (US); Alan D. Abbott, Manlius, NY (US); Raymond L. Senf, Jr., Central Square, NY (US)

(73) Assignee: CARRIER CORPORATION, Farmington, CT (US)

( * ) Notice: Subject to any disclaimer, the term of this patent is extended or adjusted under 35 U.S.C. 154(b) by 906 days.

(21) Appl. No.: 13/057,337

(22) PCT Filed: Sep. 21, 2009

(86) PCT No.: PCT/US2009/057688

§ 371 (c)(1),
(2), (4) Date: Feb. 3, 2011

(87) PCT Pub. No.: WO2010/036614

PCT Pub. Date: Apr. 1, 2010

(65) Prior Publication Data

US 2011/0132007 A1 Jun. 9, 2011

Related U.S. Application Data

(60) Provisional application No. 61/100,445, filed on Sep. 26, 2008.

(51) Int. Cl.
*F25B 49/02* (2006.01)

(52) U.S. Cl.
CPC .... *F25B 49/027* (2013.01); *F25B 2600/2513* (2013.01); *F25B 2700/2106* (2013.01);
(Continued)

(58) Field of Classification Search
CPC ..... F25B 49/022; F25B 2700/1931; F25B 2700/21153
(Continued)

(56) References Cited

U.S. PATENT DOCUMENTS 4,986,084 A 1/1991 Beckhusen
5,689,963 A * 11/1997 Bahel et al. ..... 62/129
(Continued)

FOREIGN PATENT DOCUMENTS

CN 1959305 A 5/2007
CN 101091093 A 12/2007
(Continued)

OTHER PUBLICATIONS

Love, Richard J., et al. "What is the optimum compressor discharge pressure set point for condensers." EcoLibrium (Aug. 2005) (2005): 24-29.*
(Continued)

*Primary Examiner* — M. Alexandra Elve
*Assistant Examiner* — Alexis Cox
(74) *Attorney, Agent, or Firm* — Cantor Colburn LLP

(57) ABSTRACT

In a refrigeration system having a compressor, a condenser, an evaporator, and a controller for controlling an expansion valve, a process for controlling compressor discharge during a cooling cycle includes monitoring a compressor discharge temperature, operating the expansion valve in a base mode wherein the expansion valve is controlled in response to a difference between actual superheat and desired superheat of the evaporator; and controlling the expansion valve in response to a difference between a set point and a compressor discharge parameter when the ambient air temperature, the return air temperature and the compressor discharge temperature meet respective limits.

6 Claims, 3 Drawing Sheets

(52) U.S. Cl.
CPC ..... *F25B 2700/21152* (2013.01); *F25B 2700/21172* (2013.01)

(58) Field of Classification Search
USPC ..... 62/210, 204
See application file for complete search history.

(56) References Cited

U.S. PATENT DOCUMENTS

| | | | | |
|---|---|---|---|---|
| 6,148,628 | A | 11/2000 | Reason et al. | |
| 6,223,546 | B1 | 5/2001 | Chopko et al. | |
| 6,301,911 | B1 | 10/2001 | Reason et al. | |
| 6,318,100 | B1 | 11/2001 | Brendel et al. | |
| 6,318,101 | B1 | 11/2001 | Pham et al. | |
| 6,321,549 | B1 | 11/2001 | Reason et al. | |
| 6,517,332 | B1 | 2/2003 | Lifson et al. | |
| 6,532,433 | B2 | 3/2003 | Bharadwaj et al. | |
| 6,571,576 | B1 | 6/2003 | Lifson et al. | |
| 6,588,222 | B1 * | 7/2003 | Christen et al. | 62/127 |
| 6,622,500 | B1 * | 9/2003 | Archibald et al. | 62/173 |
| 6,779,354 | B2 | 8/2004 | Nakata | |
| 6,826,926 | B2 | 12/2004 | Rousseau et al. | |
| 6,923,111 | B2 | 8/2005 | Kiefer et al. | |
| 6,938,438 | B2 | 9/2005 | Lifson et al. | |
| 6,951,116 | B2 | 10/2005 | Lee et al. | |
| 7,143,594 | B2 | 12/2006 | Ludwig et al. | |
| 8,069,684 | B2 * | 12/2011 | Heinbokel et al. | 62/225 |
| 8,375,733 | B2 * | 2/2013 | Preston et al. | 62/186 |
| 2002/0162344 | A1 * | 11/2002 | Reason et al. | 62/217 |
| 2003/0077179 | A1 | 4/2003 | Collins et al. | |
| 2006/0144059 | A1 | 7/2006 | Kang et al. | |
| 2007/0062207 | A1 | 3/2007 | Aiyama et al. | |
| 2008/0229770 | A1 * | 9/2008 | Liu | 62/225 |
| 2010/0205989 | A1 * | 8/2010 | Creed et al. | 62/228.5 |
| 2012/0247138 | A1 * | 10/2012 | Senf et al. | 62/191 |
| 2012/0260678 | A1 * | 10/2012 | Yoshida | 62/56 |

FOREIGN PATENT DOCUMENTS

| | | | |
|---|---|---|---|
| JP | 2003156244 | A | 5/2003 |
| KR | 20030012247 | | 2/2003 |
| KR | 20030021939 | | 3/2003 |
| KR | 100718448 | B1 | 5/2007 |
| WO | 2006049919 | A2 | 5/2006 |
| WO | 2008039204 | A1 | 4/2008 |

OTHER PUBLICATIONS

"Parameter, n." OED Online. Oxford University Press, Jun. 2014. Web. Jul. 10, 2014.*

"Parameter, n.". OED Online. Sep. 2015. Oxford University Press. http://www.oed.com/view/Entry/137519?redirectedFrom=parameter (accessed Sep. 15, 2015).*

International search Report and Written Opinion mailed Apr. 22, 2010 (11 pgs.).

Translation of Chinese Office Action for application CN 200980137784.X, Sep. 21, 2009, 15 pages.

European Search Report for application EP 09816744.8, dated Dec. 3, 2014, 8 pages.

International Search Report for application PCT/US2009/057688, mailed Apr. 22, 2010, 3 pages.

* cited by examiner

COMPRESSOR DISCHARGE CONTROL ON A TRANSPORT REFRIGERATION SYSTEM

CROSS-REFERENCE TO RELATED APPLICATION

Reference is made to and this application claims priority from and the benefit of U.S. Provisional Application Ser. No. 61/100,445, filed Sep. 26, 2008, entitled "COMPRESSOR DISCHARGE CONTROL ON A TRANSPORT REFRIGERATION SYSTEM", which application is incorporated herein in its entirety by reference.

FIELD OF THE INVENTION

This disclosure relates generally to transport refrigeration units and, more specifically, to controlling compressor discharge superheat without a quench valve.

BACKGROUND OF THE INVENTION

A transport refrigeration system used to control enclosed areas, such as the insulated box used on trucks, trailers, containers, or similar intermodal units, functions by absorbing heat from the enclosed area and releasing heat outside of the box into the environment. The transport refrigeration system commonly includes a compressor to pressurize refrigerant vapor, and a condenser to cool the pressurized vapor from the compressor, thereby changing the state of the refrigerant from a gas to a liquid. Ambient air may be blown across the refrigerant coils in the condenser to effect the heat exchange. The transport refrigeration system further includes an evaporator for drawing heat out of the box by drawing or pushing return air across refrigerant-containing coils within the evaporator. This step vaporizes any remaining liquid refrigerant flowing through the evaporator, which may then be drawn through a suction modulation valve (SMV) and back into the compressor to complete the circuit. The system may include a thermostatic expansion valve (TXV) in the refrigerant line upstream of the evaporator, which is responsive to the superheat generated in the evaporator (superheat being defined as the difference between the sensed vapor temperature and the saturation temperature at the same pressure). The transport refrigeration system also commonly includes an electric generator adapted to produce AC current at a selected voltage and frequency to operate a compressor drive motor driving the refrigeration compressor.

Some refrigeration systems, including transport refrigeration, require operation at reduced capacity to hold product within a very narrow temperature range. In some cases suction modulation is used to reduce and regulate capacity. This affects suction and discharge temperatures. When suction modulation occurs at high ambient temperatures, the refrigerant supplied to the compressor may be too hot, absent some correcting measures, resulting in compressor discharge temperatures that are too high.

Further, refrigeration systems that operate at low suction density and low mass flow conditions coupled with high compression ratios require additional compression temperature controls. In other refrigeration systems, such as mobile container systems used in tropical climates, a high ambient temperature adversely affects the temperature of the refrigerant, particularly the compressor discharge temperature. If discharge temperatures are not prevented from getting too hot, the compressor lubricant can break down and ultimately cause failure of the compressor.

Typical methods for controlling compressor discharge temperature include injecting liquid refrigerant by use of a liquid injection circuit via the economizer/vapor injection port on the compressor. One approach to injecting liquid refrigerant is by a solenoid-operated valve, commonly referred to as a quench valve. The quench valve bypasses the evaporator, that is, the liquid line tees off upstream of the evaporator and dumps in at the compressor suction inlet.

Unfortunately, refrigeration systems utilizing a quench valve have increased complexity, which increases cost. The increased complexity also makes system packaging more difficult in the confined space of a transport refrigeration system. Further, additional control parameters must be designed and implemented into the system controller.

Another drawback of systems utilizing a quench valve is that the liquid refrigerant bypasses the evaporator, thereby decreasing system efficiency. Also, the compressor superheat is more difficult to control with the use of a solenoid valve because large slugs of liquid are dumped into the suction inlet of the compressor. Too much liquid refrigerant can also result in floodback to the compressor and can ultimately cause failure of the compressor.

SUMMARY OF THE INVENTION

A stable system and process is provided to control the degree of compressor superheat without the use of a quench valve.

In a refrigeration system having a compressor, a condenser, an evaporator, and a controller for controlling an expansion valve, a process is provided for controlling compressor discharge during a cooling cycle comprising the steps of monitoring a compressor discharge parameter, comparing the compressor discharge parameter to a set point stored in a controller memory, and selectively operating the expansion valve upstream of the evaporator in response to a difference between the compressor discharge parameter and the set point. The compressor discharge parameter may be temperature, wherein the set point value may be about 132 degrees Celsius.

The process may further include the steps of monitoring an ambient temperature and a return air temperature and comparing the ambient temperature, the return air temperature, and the compressor discharge parameter to a first predetermined limit stored in the controller memory. The process for controlling compressor discharge during a cooling cycle is initiated only if the ambient temperature, the air return temperature, and the compressor discharge parameter meet the first predetermined limit. The first predetermined limit may be the ambient temperature is greater than about 43 degrees Celsius, the return air temperature is less than about negative 18 degrees Celsius, and the compressor discharge temperature is greater than about 118 degrees Celsius.

The process may further include the steps of stopping the process if a process parameter meets a second predetermined limit. The process parameter may be return air temperature or ambient air temperature, and the second predetermined limit may be greater than about negative 18 degrees Celsius, and less than about 38 degrees Celsius, respectively.

The step of operating the expansion valve may include operating the expansion valve in the absence of separately injecting liquid refrigerant at a location between the inlet of the compressor and the exit of the evaporator.

BRIEF DESCRIPTION OF THE DRAWINGS

For a further understanding of the invention, reference will be made to the following detailed description of the invention which is to be read in connection with the accompanying drawing, wherein.

DETAILED DESCRIPTION OF THE INVENTION

Figure 1:
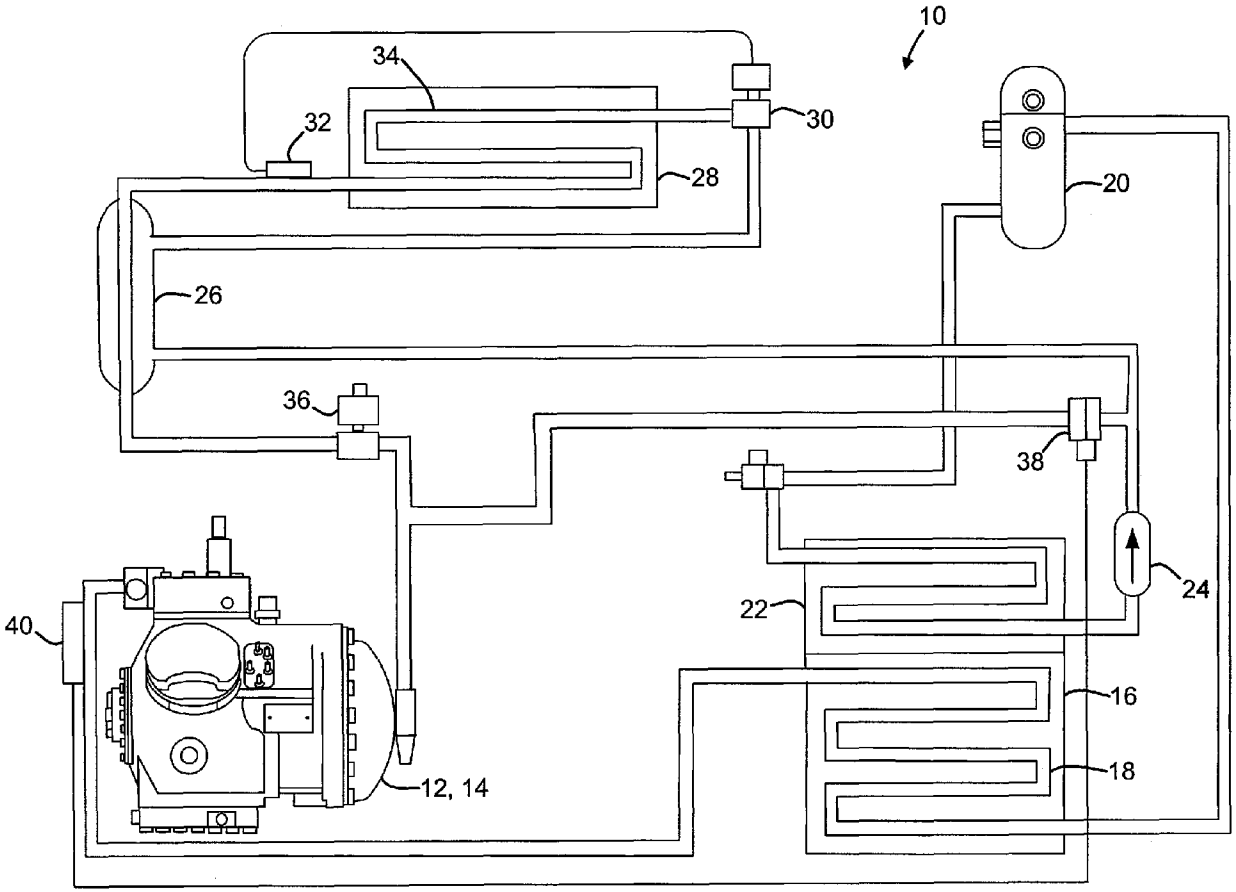
FIG. 1 PRIOR ART
FIG. 1 schematically illustrates a prior art refrigeration system.

FIG. 1 shows a schematic representation of an exemplary embodiment of a refrigerant vapor compression system 10, such as a conventional prior art transportation refrigeration system. Such a system 10 typically includes a compressor 12, such as a reciprocating compressor, which is driven by a motor 14 to compress refrigerant. In the compressor, the refrigerant is compressed to a higher temperature and pressure. The refrigerant then moves to a condenser 16, which may be an air-cooled condenser. The condenser 16 includes a plurality of condenser coil fins and tubes 18, which receives air, typically blown by a condenser fan (not shown). By removing latent heat through this step, the refrigerant condenses to a high pressure/high temperature liquid and flows to a receiver 20 that provides storage for excess liquid refrigerant during low temperature operation. From the receiver 20, the refrigerant flows through subcooler unit 22, then to a filter-drier 24 which keeps the refrigerant clean and dry, and then to a heat exchanger 26, which increases the refrigerant subcooling. Finally, the refrigerant flows through the evaporator 28 prior to reentry into the compressor 12. The flow rate of refrigerant through the evaporator 28 in such prior art would be modulated through a mechanical thermostatic expansion valve ("TXV") 30 responding to the feedback from the evaporator through an expansion valve bulb 32. The expansion valve 30 regulates the amount of refrigerant delivered to the evaporator 28 to establish a pre-determined superheat at the outlet of evaporator, hereinafter evaporator superheat (ESH) 33. As the liquid refrigerant passes through the orifice of the expansion valve 30, at least some of it vaporizes. The refrigerant then flows through the tubes or coils 34 of the evaporator 28, which absorbs heat from the return air (i.e., air returning from the box) and in so doing, vaporizes the remaining liquid refrigerant. The return air is preferably drawn or pushed across the tubes or coils 34 by at least one evaporator fan (not shown). The refrigerant vapor is then drawn from the evaporator 28 through a suction modulation valve ("SMV") 36 back into the compressor 12.

The prior art refrigerant vapor compression system 10 also includes a liquid injection valve ("LIV") 38, or quench valve, connecting the liquid line from the receiver 20 to the suction line at a point between the suction modulation valve 36 and compressor 12. LIV 36 has a sensing bulb 40 located on the compressor discharge line. In operation, LIV 36 is controlled responsive to the superheat measured at the compressor discharge. If the superheat sensed by the bulb 40 is higher than a predetermined value, LIV 36 opens to allow liquid refrigerant into the compressor suction inlet. Once the bulb 40 senses the superheat is within predetermined limits, LIV 36 closes.

Figure 2:
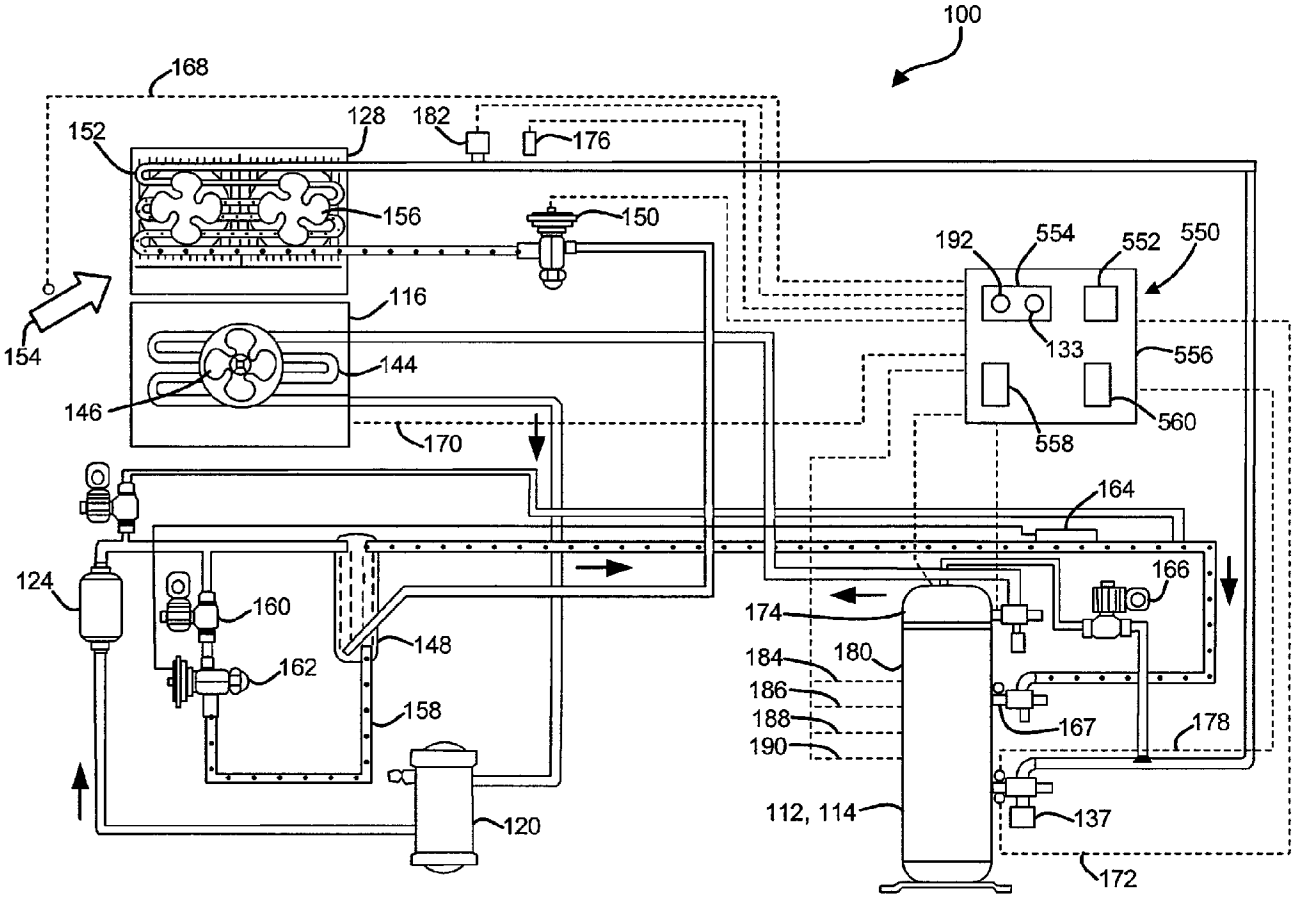
FIG. 2 schematically illustrates an exemplary embodiment of a refrigeration system in accordance with the present invention.

Referring to FIG. 2, wherein like numerals indicate like elements from FIG. 1, there is shown schematically an exemplary embodiment of a refrigerant vapor compression system 100 according to the present disclosure. The refrigerant (which, in the disclosed embodiment is R134A) is used to cool the box air (i.e., the air within the container or trailer or truck) of the refrigerant vapor compression system 100. In the depicted embodiment, compressor 112 is a scroll compressor, however other compressors such as reciprocating or screw compressors are possible without limiting the scope of the disclosure. Motor 114 may be an integrated electric drive motor driven by a synchronous generator (not shown) operating at low speed (for example, 45 Hz) or high speed (for example, 65 Hz). Another embodiment of the present disclosure, however, provides for motor 114 to be a diesel engine, such as a four cylinder, 2200 cc displacement diesel engine which operates at a high speed (about 1950 RPM) or at low speed (about 1350 RPM).

High temperature, high pressure refrigerant vapor exiting the compressor 112 then moves to the air-cooled condenser 116, which includes a plurality of condenser coil fins and tubes 144, which receive air, typically blown by a condenser fan 146. By removing latent heat through this step, the refrigerant condenses to a high pressure/high temperature liquid and flows to the receiver 120 that provides storage for excess liquid refrigerant during low temperature operation. From the receiver 120, the refrigerant flows to the filter-drier 124 which keeps the refrigerant clean and dry, and then through an economizer heat exchanger 148, which increases the refrigerant subcooling.

The refrigerant flows from the economizer heat exchanger 148 to an electronic expansion valve ("EXV") 150. As the liquid refrigerant passes through the orifice of the EXV, at least some of it vaporizes. The refrigerant then flows through the tubes or coils 152 of the evaporator 128, which absorbs heat from the return air 154 (i.e., air returning from the box) and in so doing, vaporizes the remaining liquid refrigerant. The return air is preferably drawn or pushed across the tubes or coils 152 by at least one evaporator fan 156. The refrigerant vapor is then drawn from the evaporator 128 through the suction service valve 137 back into the compressor.

The system 100 further includes an economizer circuit 158. When the circuit is active, valve 160 opens to allow refrigerant to pass through an auxiliary expansion valve 162 having a sensing bulb 164 located upstream of an intermediate inlet port 167 of the compressor 112. The valve 162 is controlled responsive to the temperature measured at the bulb 164, and serves to expand and cool the refrigerant which proceeds into the economizer counter-flow heat exchanger 148, thereby subcooling the liquid refrigerant proceeding to EXV 150.

The system 100 further includes a digital unloader valve 166 connecting the discharge of the compressor 112 to the suction inlet. In the event the system 100 generates excessive pressure differential or amperage draw, the unloader valve 166 opens and equalizes the pressure between discharge and suction thereby causing the scroll set to separate and stop the flow of refrigerant.

Many of the points in the refrigerant vapor compression system 100 are monitored and controlled by a controller 550. Controller 550 includes a microprocessor 552 and its associated memory 554. The memory 554 of controller 550 can contain operator or owner preselected, desired values for various operating parameters within the system 100 including, but not limited to, temperature set points for various locations within the system 100 or the box, pressure limits, current limits, engine speed limits, and any variety of other desired operating parameters or limits with the system 100. In the disclosed embodiment, controller 550 includes a microprocessor board 556 that contains microprocessor 552 and memory 556, an input/output (I/O) board 558, which contains an analog to digital converter 560 which receives temperature inputs and pressure inputs from various points in the system, AC current inputs, DC current inputs, voltage inputs and humidity level inputs. In addition, I/O board 558 includes drive circuits or field effect transistors ("FETs") and relays which receive signals or current from the controller 550 and in turn control various external or peripheral devices in the system 100, such as EXV 150, for example.

Among the specific sensors and transducers monitored by controller 550 are the return air temperature (RAT) sensor 168 which inputs into the microprocessor 552 a variable resistor value according to the evaporator return air temperature; the ambient air temperature (AAT) sensor 170 which inputs into microprocessor 552 a variable resistor value according to the ambient air temperature read in front of the condenser 116; the compressor suction temperature (CST) sensor 172; which inputs to the microprocessor a variable resistor value according to the compressor suction temperature; the compressor discharge temperature (CDT) sensor 174, which inputs to microprocessor 552 a resistor value according to the compressor discharge temperature inside the dome of compressor 112; the evaporator outlet temperature (EVOT) sensor 176, which inputs to microprocessor 552 a variable resistor value according to the outlet temperature of evaporator 128; the compressor suction pressure (CSP) transducer 178, which inputs to microprocessor 552 a variable voltage according to the compressor suction value of compressor 112; the compressor discharge pressure (CDP) transducer 180, which inputs to microprocessor 552 a variable voltage according to the compressor discharge value of compressor 112; the evaporator outlet pressure (EVOP) transducer 182 which inputs to microprocessor 552 a variable voltage according to the evaporator outlet pressure or evaporator 128; direct current sensor 186 and alternating current sensor 188 (CT1 and CT2, respectively), which input to microprocessor 552 a variable voltage values corresponding to the current drawn by the system 100.

One of the improvements of the present disclosure is the elimination of the liquid injection valve (LIV) and associated plumbing and controller elements. Whereas prior art refrigeration systems have heavily relied upon the injection of liquid refrigerant into the inlet of compressor stages to control the degree of compressor superheat, the present disclosure presents a unique process to control the compressor superheat without relying on the LIV, as will be explained in detail below.

In the base implementation of the disclosed embodiment, the microprocessor 552 uses inputs from the EVOP sensor 182 and EVOT sensor 176 in order to calculate the evaporator coil evaporator superheat and store the calculation in memory module 133, using algorithms understood by those of ordinary skill in the art. The microprocessor 552 then compares the calculated evaporator superheat value to a preselected, desired superheat value, or set point, stored in memory 556. The microprocessor 552 is programmed to actuate the EXV 150 depending upon differences between actual and desired superheat in order to maintain the desired superheat setting (i.e., the minimum superheat so as to maximize unit capacity). Microprocessor 552 may be programmed to maintain the lowest setting of superheat which will maintain control and still not cause flood back (i.e., escape of liquid refrigerant into the compressor). This value will vary depending upon the capacity and specific configuration of the system, and can be determined through experimentation by those of ordinary skill in the art. This lowest level of superheat may then be used as the "base" setting from which superheat offsets are made in the event of various operating and/or ambient conditions.

In the base implementation discussed above, it has been learned that the concomitant superheat generated in the compressor 112 exceeds safety limits in some operating regimes. One example of such a regime is when the ambient temperature is greater than 43.3° C. (110° F.), the return air temperature is less than −18° C. (0° F.), and the compressor discharge temperature is greater than 118° C. (244.4° F.). The inventors have discovered that conventional control techniques, that is, controlling evaporator superheat, were ineffective in preventing compressor discharge overheating if the quench valve was eliminated from the system and the above conditions were reached. In the base implementation, the compressor discharge temperature continued to rise. To combat this, the evaporator superheat set point was successively decreased in an effort to add more liquid refrigerant to the compressor 112. However, even when the evaporator superheat set point was 1.5° C., insufficient liquid refrigerant was delivered to the compressor 112 to keep the discharge temperature within acceptable operating limits. Further decreasing the set point resulted in zero superheat, meaning that the refrigerant was in the dome of the PH diagram. This condition rendered the expansion valve 150 unstable because the liquid/vapor constituency (quality) was undeterminable at the operating temperature and pressure. A control algorithm different from the base implementation was needed to control the superheat generated in the compressor.

Figure 3:
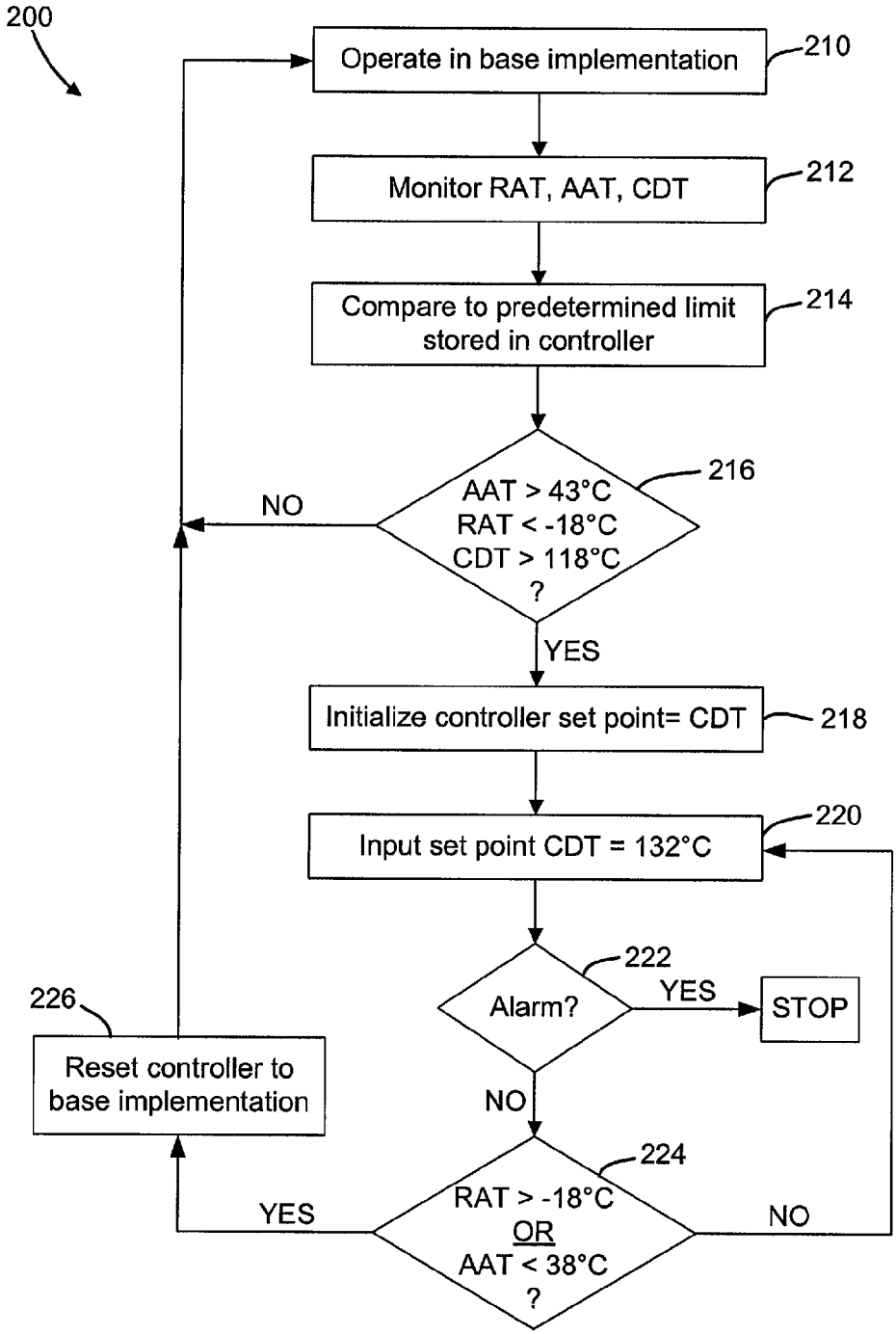
FIG. 3 is a block diagram collectively presenting a flow chart illustrating an exemplary embodiment of the process for controlling compressor superheat during operation of a refrigeration system.

Referring to FIGS. 2 and 3, a process 200 for controlling compressor discharge superheat during a cooling cycle is shown. The process 200 comprises a step 210 of operating in the base implementation mode where, in the disclosed example, control of EXV 150 is responsive to evaporator 128 superheat. At a step 212, the RAT sensor 168, AAT sensor 170, and CDT sensor 174 are monitored. At a step 214, the monitored values are compared with a first predetermined limit stored in the controller 550. If in step 216 the first predetermined limit is not met, control of the system 100 remains in base implementation. In the disclosed embodiment, the first predetermined limit is: the ambient air temperature is greater than 43.3° C. (110° F.), the return air temperature is less than −18° C. (0° F.), and the compressor discharge temperature is greater than 118° C. (244.4° F.). If the first predetermined limit is met, control of EXV 150 is selected to be responsive to a compressor discharge parameter.

At a step 218, the set point for the microprocessor 552 controlling EXV 50 is changed from the evaporator superheat set point to a compressor discharge parameter. In the disclosed embodiment, the compressor discharge parameter is the compressor discharge temperature, as sensed by CDT 174. However, in another embodiment, the compressor discharge parameter is the compressor superheat, as calculated using the CDT sensor 174 and CDP sensor 180, as will be discussed below. The set point is initialized with a value equal to the then-existing reading from the CDT sensor 174. This initialization process essentially results in zero error between the set point and EXV 150 position and prevents the EXV from large initialization errors.

After initialization, a final set point for the compressor discharge parameter is input to the microprocessor at a step 220, along with instructions to reach the set point in a predetermined period of time. In the disclosed example, the set point is compressor discharge temperature equal to 132.2° C. (270° F.), and the period of time is 90 seconds. As can be seen from the above example, the control algorithm is initiated when the compressor discharge temperature is lower than the set point. The inventors have discovered that the system 100 is easier to control and the set point is easier to achieve if the process 200 is initiated before the compressor discharge temperature rises to the desired set point. If the process 200 is initiated when the compressor discharge temperature is higher than the set point, the system 100 is more difficult to bring into control.

In one example, the process 200 utilizes a proportional-integral-derivative (PID) controller to correct the error between the measured compressor discharge parameter and the desired set point. The PID calculates and then outputs a corrective action that can adjust EXV 150 to bring the compressor discharge temperature closer to the set point. The proportional value determines the reaction to the current error, the integral value determines the reaction based on the sum of recent errors, and the derivative value determines the reaction to the rate at which the error has been changing. Together, the weighted sum of these three values is used to adjust the compressor discharge parameter via the position of EXV 150. In the disclosed example, the set point values to the PID were changed as disclosed herein, but the proportional values, integral values, and derivative values remained unchanged from the values used in the prior art system.

The process 200 continues until either the return air temperature or the ambient temperature meets a second predetermined limit, or an alarm condition is encountered. At a step 222, various system diagnostic monitoring checks are conducted, and if any alarm conditions are encountered, the process 200 is stopped and the system 100 is shut down or remedial action is taken. In one example, if the compressor discharge temperature as measured by CDT 174 is approximately equal to the ambient temperature as sensed by AAT 170 for a period of ten minutes, an alarm code is signaled indicating the discharge temperature sensor has failed.

At a step 224, a check is conducted to determine if conditions warrant returning to the base implementation mode of operation. If a process parameter meets a second predetermined limit, the control algorithm reverts back to the base implementation mode at a step 226 and the process 200 starts over at step 210. In one example, the process parameter is return air temperature as sensed by RAT sensor 168, and the second predetermined limit is greater than −17.8° C. (0° F.). In another example, the process parameter is ambient air temperature as sensed by AAT sensor 170, and the second predetermined limit is less than 37.8° C. (100° F.). In other example embodiments, the second predetermined limit on the process parameter may result in the process 200 essentially becoming the base implementation.

As discussed above, in another embodiment of the present disclosure, the process for controlling compressor discharge superheat is controlled by a different compressor discharge parameter, for example the compressor superheat as calculated by the CDT sensor 174 and CDP sensor 180. In this particular embodiment, at the step 212 the compressor discharge pressure as sensed by CDP sensor 180 is also monitored. At a step 217, the microprocessor 552 calculates a compressor discharge superheat (CDSH) value 192 and stores the value in memory 554. The CDSH value 192 is determined by first calculating a compressor discharge saturated temperature using the value sensed from the CDP sensor 180 and known algorithms, then subtracting the compressor discharge saturated temperature from the sensed compressor discharge temperature. At the initialization step 218, the set point is initialized with a value equal to the then-existing CDSH value 192. At the step 220, the compressor superheat set point is input as 22.8° C. (73° F.), and the period of time to reach the set point is 90 seconds.

One advantage of the disclosed system 100 is that it is less complex. Elimination of the liquid quench valve and associated plumbing and control elements simplifies the design and reduces manufacturing costs.

Another advantage of the disclosed system 100 and process 200 is that it is more efficient. As can be seen with reference to FIG. 1, the liquid injection valve 138 and associated plumbing essentially bypasses the evaporator 128. When the LIV 138 is open, the system 100 is less efficient because the capacity of the evaporator 128 is reduced by the amount of refrigerant bypassed.

Another advantage is increased stability of the system 100. In prior art systems such as that depicted in FIG. 1, the LIV 138 is a solenoid valve. By virtue of its design, the valve is either open or closed, which results in large slugs of liquid refrigerant being dumped into the suction inlet of the compressor 112. The slugs of liquid can lead to instability in the compressor 112. Elimination of the LIV 138 also eliminates the source of instability.

We claim:

1. A refrigerant vapor compression system comprising:

a compressor for compressing a refrigerant, the compressor having a suction port, a discharge port, and a compressor discharge temperature sensor operatively coupled to the discharge port, the compressor discharge temperature sensor configured to provide a compressor discharge temperature;

an air-cooled heat exchanger operatively coupled to the discharge port of the compressor;

an evaporator heat exchanger operatively coupled to the air-cooled heat exchanger and the suction port of the compressor, and at least one of an evaporator outlet pressure sensor and an evaporator outlet temperature sensor operatively coupled to the evaporator;

an expansion valve coupled to the inlet of the evaporator for at least partially vaporizing the refrigerant entering the evaporator;

an ambient air temperature sensor for monitoring an ambient air temperature;

a return air temperature sensor for monitoring a return air temperature; and a controller operatively associated with the expansion valve, the controller configured to:

operate the expansion valve in a base mode wherein the expansion valve is controlled in response to a difference between actual superheat and desired superheat of the evaporator; and in response to the ambient air temperature, the return air temperature and the compressor discharge temperature meeting respective limits, exiting the base mode to control the expansion valve in response to a difference between a set point and the compressor discharge temperature instead of the difference between actual superheat and desired superheat of the evaporator.

2. The refrigerant vapor compression system of claim 1, wherein the controller comprises a proportional-integral-derivative controller.

3. The refrigerant vapor compression system of claim 1, wherein the expansion valve is an electronic expansion valve.

4. The refrigerant vapor compression system of claim 1, wherein the controller is configured to control the expansion valve in response to the difference between the set point and the compressor discharge temperature when the compressor discharge temperature is greater than 118° C.

5. The refrigerant vapor compression system of claim 4, wherein the controller further configured to control the expansion valve in response to the difference between the set point and the compressor discharge temperature when the return air temperature sensor reads less than −18° C.

6. The refrigerant vapor compression system of claim 4, wherein the controller further configured to control the expansion valve in response to the difference between the set point and the compressor discharge temperature when the ambient air temperature sensor reads greater than 43° C.

* * * * *